US011292243B2

(12) United States Patent
Izume

(10) Patent No.: US 11,292,243 B2
(45) Date of Patent: Apr. 5, 2022

(54) PRINTING MACHINE AND INK FOUNTAIN DEVICE THEREOF, AND METHOD FOR CLEANING PERIPHERY OF INK FOUNTAIN

(71) Applicant: I. MER CO., LTD., Kyoto (JP)

(72) Inventor: Masayuki Izume, Kyoto (JP)

(73) Assignee: I. MER CO., LTD., Kyoto (JP)

( * ) Notice: Subject to any disclaimer, the term of this patent is extended or adjusted under 35 U.S.C. 154(b) by 0 days.

(21) Appl. No.: 16/962,519

(22) PCT Filed: Dec. 7, 2018

(86) PCT No.: PCT/JP2018/045116
§ 371 (c)(1),
(2) Date: Jul. 16, 2020

(87) PCT Pub. No.: WO2019/142535
PCT Pub. Date: Jul. 25, 2019

(65) Prior Publication Data

US 2020/0346453 A1 Nov. 5, 2020

(30) Foreign Application Priority Data

Jan. 18, 2018 (JP) ..... JP2018-006144

(51) Int. Cl.
*B41F 31/04* (2006.01)
*B41F 35/04* (2006.01)

(52) U.S. Cl.
CPC ..... *B41F 31/04* (2013.01); *B41F 35/04* (2013.01)

(58) Field of Classification Search
CPC ..... B41F 31/04; B41F 35/04; B41F 31/05; B41F 31/20; B41F 31/045; B41F 31/10;
(Continued)

(56) References Cited

U.S. PATENT DOCUMENTS 3,913,479 A 10/1975 Cappel et al.
4,624,183 A 11/1986 Kunkel et al.
(Continued)

FOREIGN PATENT DOCUMENTS

AU 1752400 A 8/2000
EP 0166955 A2 * 1/1986 ..... B41F 31/04
(Continued)

OTHER PUBLICATIONS

Official Communication issued in International Patent Application No. PCT/JP2018/045116, dated Jan. 15, 2019.
(Continued)

*Primary Examiner* — Leslie J Evanisko
*Assistant Examiner* — Leo T Hinze
(74) *Attorney, Agent, or Firm* — Keating and Bennett, LLP

(57) ABSTRACT

An ink fountain of an ink fountain device is provided with a fixed frame; a plate slidable on the upper surface of the plate; and an advancement and retraction mechanism advancing and retracting the plate with respect to the frame. The advancement and retraction mechanism comprises: a motor; a cam fixed to the output shaft of the motor which is integrally rotatable by rotation of the output shaft and has a cam surface shifted from an exact circle; and a rod in contact with the cam surface and advancing and retracting by the cam. The plate advances and retracts with respect to the frame by the advancement and retraction of the rod.

7 Claims, 5 Drawing Sheets

(58) Field of Classification Search
CPC ..... B41P 2235/21; B41P 2231/20; B41P 2235/20
See application file for complete search history.

(56) References Cited

U.S. PATENT DOCUMENTS

| | | | |
|---|---|---|---|
| 5,505,131 | A | 4/1996 | Hachiya et al. |
| 5,603,262 | A | 2/1997 | Uera et al. |
| 5,709,148 | A | 1/1998 | Uera et al. |
| 2017/0301087 | A1 | 10/2017 | Yuyama et al. |

FOREIGN PATENT DOCUMENTS

| | | | |
|---|---|---|---|
| EP | 2 397 328 | A1 | 12/2011 |
| FR | 2 357 368 | A1 | 2/1978 |
| JP | 09-001780 | A | 1/1997 |
| JP | 09-123412 | A | 5/1997 |
| JP | 10-024557 | A | 1/1998 |
| JP | 3194174 | B2 | 7/2001 |
| JP | 2006-062773 | A | 3/2006 |
| JP | 2011-184173 | A | 9/2011 |

OTHER PUBLICATIONS

Official Communication issued in corresponding European Patent Application No. 18901321.2, dated Aug. 5, 2021.

* cited by examiner

6

6

6

PRINTING MACHINE AND INK FOUNTAIN DEVICE THEREOF, AND METHOD FOR CLEANING PERIPHERY OF INK FOUNTAIN

FIELD OF THE INVENTION

The present invention relates to an ink fountain device of a printing machine and, in particular, to the cleaning of ink reserved in the ink fountain device.

BACKGROUND ART

When printing on recycled papers, paper dust is generated during printing and becomes thick as it forms a mixture with ink. Then, the gap between an ink fountain roller and the ink fountain is clogged, and the ink supply from the ink fountain roller is prevented. Since the paper dust clogs not uniformly in the gap, variation in printing density occurs along the axial direction of the ink fountain roller.

The present inventor has considered, as a new technology, to retract the ink fountain from the ink fountain roller and to enlarge the gap in order to eliminate the paper dust, and so on. In order to make the gap between the ink fountain and the ink fountain roller cleaned during printing, the inventor has found, during the development of the new technology, the width of the gap has to be accurately controlled. Regarding the advancement and retraction of the ink fountain, Patent Document 1 (JP3194174B) has proposed to rotate the ink fountain about its axis. While this method changes the gap between the ink fountain and the ink fountain roller, accurate control of the width of the gap is difficult.

PRIOR ART DOCUMENT

Patent Document

Patent Document 1: JP3194174B

SUMMARY OF THE INVENTION

Problems to be Solved by the Invention

The object of the invention is to change accurately the gap between the ink fountain and the ink fountain roller during printing.

Another object of the invention is to make the gap between the ink fountain and the ink fountain roller cleaned, by enlarging the gap between the ink fountain and the ink fountain roller temporally during printing.

Means for Solving the Problems

An ink fountain device according to the invention has an ink fountain for forming ink reservation between an ink fountain roller in a printing machine.

The ink fountain comprises: a fixed frame; a plate slidable on the upper surface of the frame; and an advancement and retraction mechanism for advancing and retracting the plate with respect to the frame.

The advancement and retraction mechanism comprises: a motor; a cam which is fixed to an output shaft of the motor, is integrally rotatable by rotation of the output shaft, and has a cam surface shifted from an exact circle; and a rod which is in contact with the cam surface and advances and retracts due to rotation of the cam surface, and the plate is configured to advance and retract with respect to the frame by advancement and retraction of the rod.

According to the invention, the advancement and retraction mechanism is highly rigid and, therefore, makes the plate accurately advance and retract toward and away from the ink fountain roller. The tip end of the plate abuts the ink fountain roller, and the ink is transferred through the gap between them. Contaminants such as paper dust are mixed with the ink and becomes thick, and, as a result, the gap is clogged. According to the invention, since the plate is advanced and retracted accurately, the clogged ink is eliminated by retracting the plate during printing, and then, the plate is advanced toward the ink fountain roller in order to continue the printing.

Preferably, the advancement and retraction mechanism further comprises: a joining member fixed to the plate and having a screw hole; and an adjusting screw having one end in contact with the rod and another end screwed in the screw hole of the joining member. The adjusting screw allows to finely adjust the distance between the joining member and the rod, and, therefore, the width of the gap between the tip end of the plate and the ink fountain roller is easily adjustable.

Preferably, the ink fountain further comprises a biasing device biasing the plate in a direction keeping contact between the rod and the cam surface. The biasing device keeps the contact between the rod and the cam surface and makes the ink fountain device more compact in comparison with a biasing device provided within the advancement and retraction mechanism. In addition, when the motor is made off, the tip end of the plate is made in contact with the ink fountain roller by the biasing device, and, therefore, the leakage of ink is prevented.

Preferably, the ink fountain further comprises a blade configured to advance and retract in a synchronized manner with the advancement and retraction of the plate and to scrape the ink from the ink fountain roller. When the plate is retracted, since the gap between the ink fountain roller and the plate is enlarged, the clogged ink within the gap is evacuated. The blade is advanced to scrape the evacuated ink.

Particularly preferably, the ink fountain further comprises: a means for detecting clogging of a gap between the ink fountain roller and the plate of the ink fountain; and a controller for controlling the advancement and retraction mechanism such that the plate is retracted from the ink fountain roller to enlarge the gap and to evacuate ink clogged within the gap, when the clogging is detected. The clogging can be detected by detecting the unevenness of ink density on the ink fountain roller, by detecting the unevenness of printing density along the axial direction of the ink fountain roller, and so on. If the gap between the ink fountain roller and the plate of the ink fountain is made cleaned when detecting the clogging, the influence of clogging is automatically eliminated.

A printing machine according to the invention comprises: in addition to the ink fountain device, the ink fountain roller; a ductor roller receiving ink from the ink fountain roller; at least an ink distribution roller, a printing plate roller; and an ink feeder feeding ink to the ink reservation. Ink clogged within the gap between the ink fountain roller and the plate of the ink fountain, (ink made thick due to contaminants such as paper dust), is evacuated and is scraped by the advanced blade. Therefore, variations in printing density due to paper dust and so on is prevented. Here, the ductor roller advances and retracts between a position in contact with the ink fountain roller and a position in contact with the ink distribution roller, and it receives ink from the ink fountain roller and delivers ink on the ink distribution roller. Further, the duty ratio that the ductor roller is in contact with the ink fountain roller is controlled to control the printing density.

When the gap between the ink fountain roller and the ink fountain is cleaned, the ink supply to the ductor roller is halted during the cleaning, and the print density reduces. Therefore, it is preferable to increase the duty ratio that the ductor roller is in contact with the ink fountain roller, before the cleaning, after the cleaning, or both before and after the cleaning, such that the ink amount that the ductor roller receives increases. Alternatively, it is preferable to feed ink to the ink reservation, before the cleaning of before and during the cleaning, such that the ink amount on the ink distribution roller has been increased in advance, and the ink lost from the ink reservation by the cleaning is replenished.

A cleaning method of ink reserved in an ink fountain according to the invention makes the gap between an ink fountain and an ink fountain roller of a printing machine that comprises: the ink fountain; the ink fountain roller; a ductor roller that receives ink from the ink fountain roller; a printing plate roller; and a blade scraping ink from the ink fountain roller.

The ink fountain comprises: a fixed frame; a plate slidable on the upper surface of the frame; and an advancement and retraction mechanism for advancing and retracting the plate with respect to the frame.

The advancement and retraction mechanism comprises: a motor; a cam which is fixed to an output shaft of the motor, is integrally rotatable by rotation of the output shaft, and has a cam surface shifted from an exact circle; and a rod which is in contact with the cam surface and advances and retracts due to rotation of the cam surface, and the plate is configured to advance and retract with respect to the frame by advancement and retraction of the rod.

By retracting the plate from the ink fountain roller and enlarging the gap between the ink fountain roller and the plate, and the ink clogged within the gap is evacuated. The blade is advanced toward the ink fountain roller and the ink is scraped from the ink fountain roller.

In the present specification, descriptions regarding the ink fountain device apply to both the printing machine and the cleaning method of ink reserved in the ink fountain, as they are.

FEATURES FOR CARRYING OUT THE INVENTION

Figure 1:
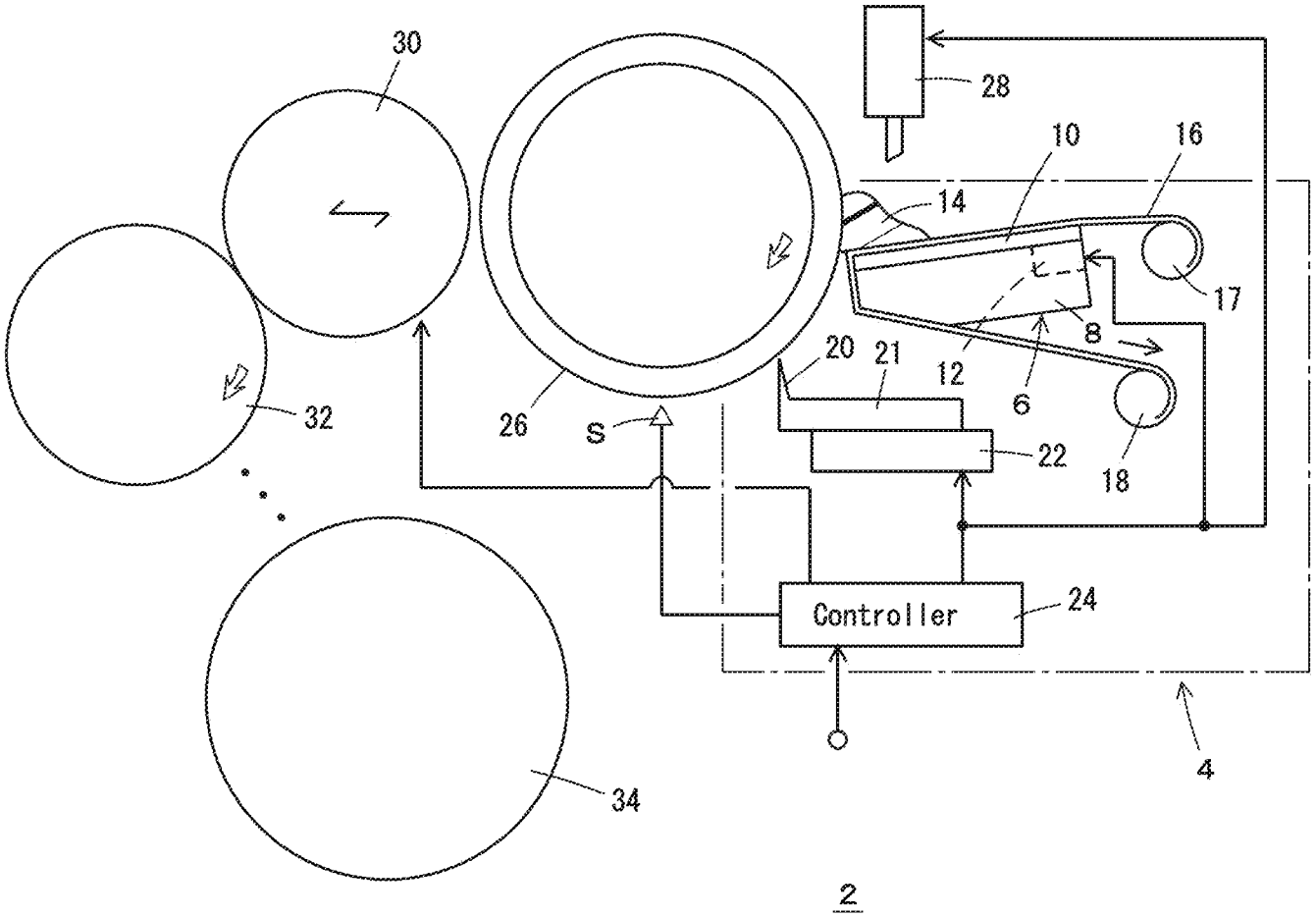
FIG. 1 A block diagram indicating major portions of a printing machine according to an embodiment.

The best embodiment for carrying out the invention will be described.

Embodiment

FIGS. 1 to 6 indicate the embodiment. The drawings show a printing machine 2 that is, for example, an offset printing press or a letterpress printing press and is provided with an ink fountain device 4. The chain line in FIG. 1 indicates the portion that the ink fountain device 4 occupies. An ink fountain 6 is provided with a fixed frame 8 and a movable plate 10 on the frame and is further provided with an advancement and retraction mechanism 12 for advancing and retracting the plate 10. Between the ink fountain 6 and an ink fountain roller 26, ink reservation is present. The upper surface of the plate 10 is covered by a film 16 that is fed from a roller 17 and is rolled up on a roller 18.

Indicated by 20 is a blade that scrapes off the ink from the ink fountain roller 26, and a pan 21 receives the scraped ink. An advancement and retraction mechanism 22 advances and retracts the blade 20 between a position in contact with the ink fountain roller 26 and a position without contact to the roller. A controller 24 of the ink fountain device 4 controls the advancement and retraction mechanisms 12, 22, and so on.

Indicated by 26 is an ink fountain roller, and by 30 is a ductor roller. Via plural ink distribution rollers 32, the ink is transferred, from the ink fountain roller 26 and then from the ductor roller 30, to a printing plate roller 34 and is printed on print media, such as paper, cans, plastic disks, and so on. An offset printing press is further provided with a blanket roller that receives the ink from the printing plate roller and transfers it on the print media. An ink feeder 28 is additionally provided in order to add ink to an ink reservation 14. The ductor roller 30 advances and retracts laterally along a left and right direction in FIG. 1: receives the ink when advancing and in contact with the ink fountain roller 26; and delivers the ink on the ink distribution roller 32 when retracting and in contact with the ink distribution roller 32. The ductor roller 30 may be divided into plural individual ductor rollers along the axial direction and the individual ductor rollers may advance and retract separately. Or, the ductor roller 30 may not be divided into the individual ductor rollers and may advance and retract all in one piece. The species of the printing machine is arbitrary as long as it has the ink reservation 14 between the ink fountain roller 26 and the ink fountain 6.

Preferably, a sensor S that monitors the ink density distribution along the axial direction of the ink fountain roller 26. When the ink density distribution along the axial direction is not uniform, the sensor S inputs a signal to the controller 24 to inform that the gap between the ink fountain roller 26 and the ink fountain 6 is clogged by paper dust or the like. Alternatively, a sensor for monitoring ink density distribution on the print media may be provided; when it detects unevenness of printing density along the axial direction of the ink fountain roller 26, it may inform the controller 24 of the unevenness. Further, an operator may detect that the gap between the ink fountain roller 26 and the ink fountain 6 is clogged by paper dust or the like and may input to the controller 24 manually. Based upon these inputs, the controller 24 controls the advancement and retraction mechanisms 12, 22 and makes them clean the gap between the ink fountain 6 and the ink fountain roller 26. As a further alternative way, when the printing machine has been operated for a predetermined period, or when it has printed, by a predetermined number, on papers and so on, the gap between the ink fountain 6 and the ink fountain roller 26 may be cleaned.

Figure 2:
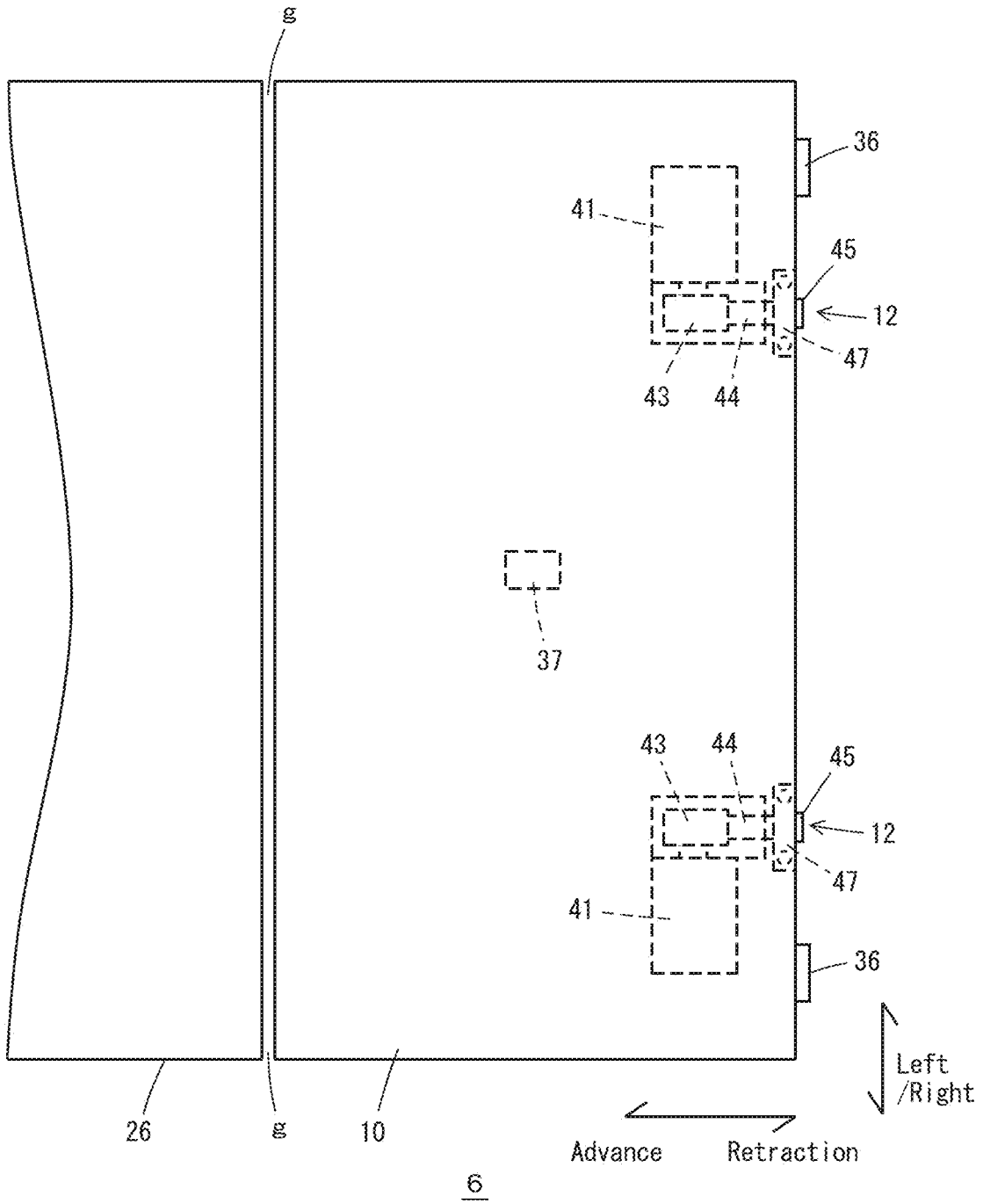
FIG. 2 A plan view of an ink fountain according to the embodiment.

The gap between the ink fountain roller 26 and the ink fountain 6 is indicated in FIG. 2 by symbol "g." When paper dust, water, or other contaminants are accumulated in this gap, the ink becomes thick and unable to pass through the gap. As a result, the printing density changes along the axial direction of the ink fountain roller 26. Therefore, the gap g is temporally widened, in order to evacuate the clogged paper dust and the ink in the gap, and then, to scrape them by the blade 20.

When the gap g (in FIG. 2) is clogged by paper dust or the like, the controller 24 makes the ink fountain 6 retracted, in order to enlarge the gap g between the ink fountain roller 26 and the ink fountain 6, and the ink in the gap is evacuated. In addition, the blade 20 is made advanced to a position in contact with the ink fountain roller 26, in a synchronous manner with the retraction of the ink fountain 6, and scrapes the ink. Then, the ink fountain 6 is made advanced toward the ink fountain roller 26, and, synchronously with this, the blade 20 is made retracted. Since the printing density depends upon the width of the gap g, the width of the gap g has to be controlled accurately.

When the width of the gap g is temporally expanded, and the evacuated ink is scraped by the blade 20, the supply amount of ink to the distribution roller 32 is temporally decreased. Therefore, preferably, the following or the like process is performed:

the duty ratio that the ductor roller 30 is in contact with the ink fountain roller 26 is increased, for example, before or after the cleaning of the gap g; or the ink is added to the ink reservation 14 from the ink feeder 28, for example, before or during the cleaning, in order to increase the reserved ink in the ink reservation 14. These processes are performed by signals from the controller 24.

Figure 3:
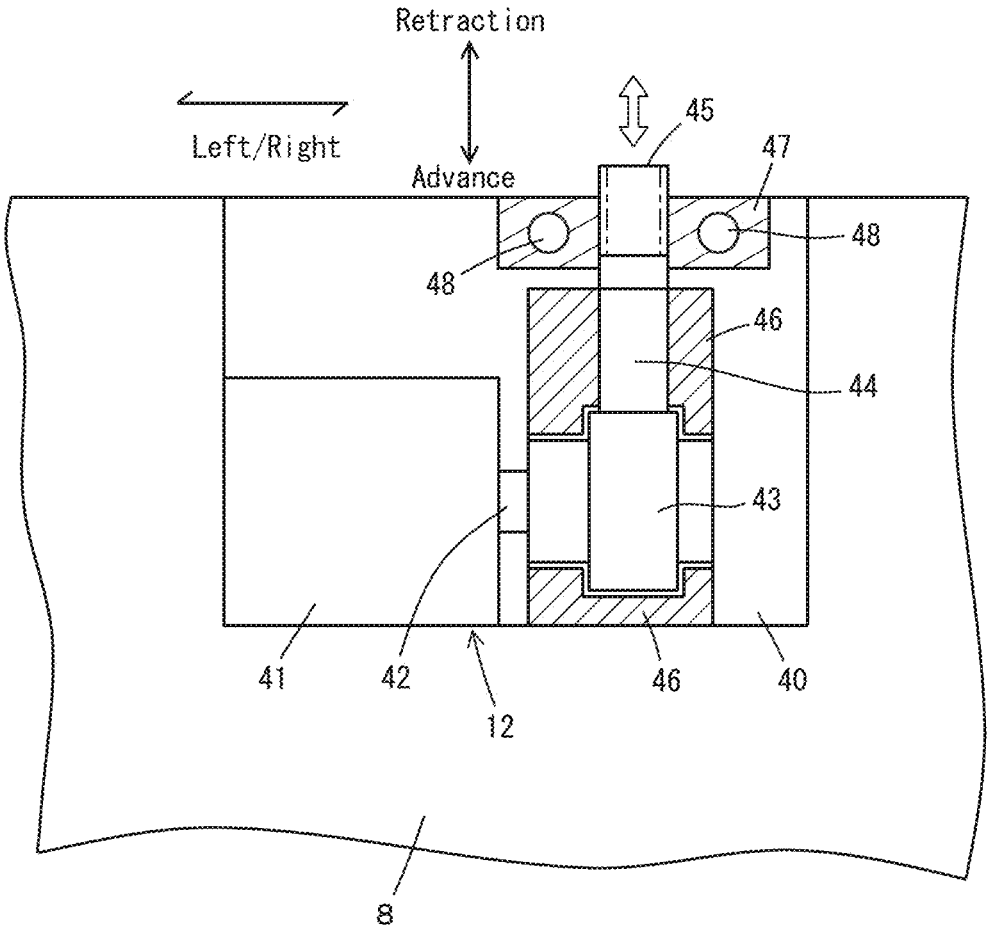
FIG. 3 A plan view of major portions of the ink fountain according to the embodiment where an ink fountain plate is removed.
Figure 4:
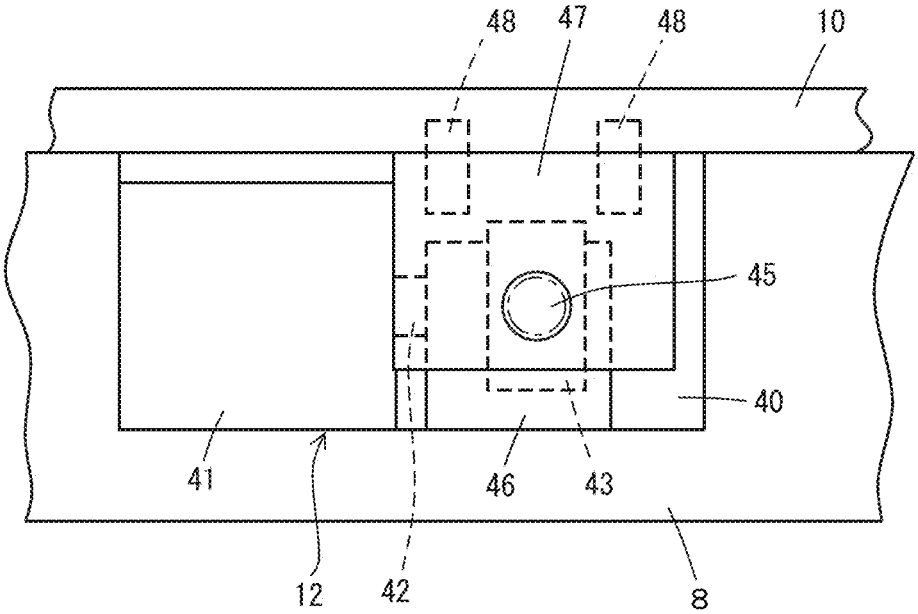
FIG. 4 A rear view of major portions of the ink fountain according to the embodiment.

FIGS. 2 to 4 indicate the structure of the ink fountain 6. In this specification, as shown in FIG. 2, "advance" means that the ink fountain 6 moves toward the ink fountain roller 26 and the gap g is narrowed, and "retraction" means that the ink fountain moves away from the ink fountain roller 26 and the gap g is widened. Further, a direction parallel to the axial direction of the ink fountain roller 26 is called the lateral direction. In addition, the plate 10 abuts at its tip the ink fountain roller 26.

As shown in FIG. 2, at the rear face of the ink fountain 6 (the opposite surface to the ink fountain roller 26), and at two positions of left and right, the advancement and retraction mechanisms 12 are provided. More, a guide 37 is provided at the center portion of the ink fountain 6 along the left and right direction and guides the advancement and retraction of the plate 10. Further, biasing devices 36 are provided at the rear surface of the ink fountain 6, for example, at two or three positions in such a way that the plate 10 is biased toward the ink fountain roller 26.

FIGS. 3 and 4 indicate the advancement and retraction mechanism 12 for the plate 10. A recess 40 is provided on the rear surface of the frame 6 and accommodates the advancement and retraction mechanism 12. A servomotor 41 is provided, but a simpler motor such as a pulse motor may be used. On the output shaft 42 of the servomotor 41, a cam 43 is attached. The cam 43 has a shape that is slightly shifted from an exact circle having a common center with the shaft 42, in a cross-section perpendicular to the shaft 42. The shift amount from the exact circle is equal to the advancement and retraction amount of the plate 10. The circumferential surface of the cam 43 is the cam surface. One end of a rod 44 is in contact with the cam surface, and the other end of the rod 44 is in contact with an adjusting screw 45. The adjusting screw 45 is screwed into a joining plate 47, and the joining plate 47 is fixed to the plate 10 by, for example, two knock pins 48. In addition, the cam 43 is rotatably accommodated within a casing 46. The way that the plate 47 is fixed to the plate 10 is arbitrary.

Figure 5:
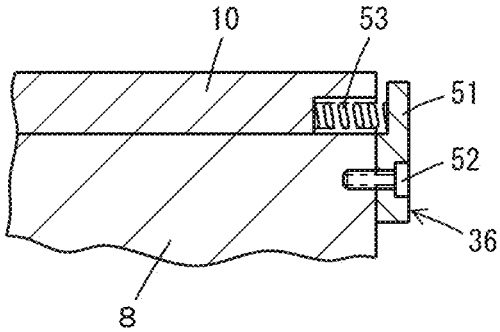
FIG. 5 A cross-sectional view of major portions of the ink fountain indicating a biasing mechanism for the ink fountain plate, according to the embodiment.

FIG. 5 indicates the structure of the biasing device 36. A plate 51 is fixed on the frame 8, for example, by a bolt 52, and a compressed spring 53 is arranged between the plate 51 and the plate 10 such that the plate 10 is biased toward the ink fountain roller 26. The function of the biasing device 36 is to bias the plate 10 toward the ink fountain roller 26, and the structure of the device is arbitrary. Alternatively, the plate 47 of the advancement and retraction mechanism may be biased toward the cam 43 by a spring not shown, but this makes the advancement and retraction mechanism larger.

Figure 6:
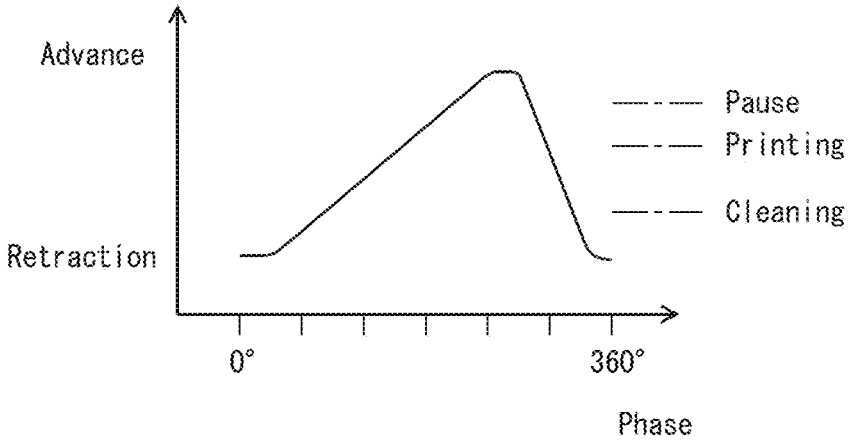
FIG. 6 A characteristic diagram indicating the relation between the advancement and retraction and the phase of a cam, according to the embodiment.

The function of the advancement and retraction mechanism 12 will be described. The relation of the phase of the cam 43 and the advancement and retraction quantity of the ink fountain plate (the distance between the cam surface and its central axis) is indicated in FIG. 6. Since the plate 10 is biased toward the advancing direction by the biasing device 36, the one end of the rod 44 is always in contact with the cam surface of the cam 43, and the other end is always in contact with the adjusting screw 45. When the servomotor 41 rotates the cam 43, the rod 44 advances and retracts, and, therefore, the joining plate 47 advances and retracts via the adjusting screw 45. Since the plate 10 is fixed to the plate 47 by the knock pins 48, the plate 10 advances and retracts according to the rotation of the cam 43.

The advancement and retraction mechanism is highly rigid. Therefore, the plate 10 advances and retracts accurately following the rotation of the servomotor 41. For example, there are no long rods or the like between the servomotor 41 and the plate 10, and, as a result, the rotation of the servomotor 41 causes directly the advancement and retraction of the plate 10. Further, there are no gears, and therefore, there is no backlash. More, the position of the plate 10 is finely adjustable by the advancement and retraction of the adjusting screw 45 to the joining plate 47.

The cam 43 changes the state of the plate 10 between the three states of:

"pause" where the width of the gap g is made almost 0, in order to prevent ink leakage from the ink reservation 14;

"printing" where the width of the gap g is kept at a predetermined value, in order to supply the ink through the gap g between the ink fountain 6 and the ink fountain roller 26; and "cleaning" where the gap g is expanded, in order to evacuate ink and paper dust or the like, for cleaning the gap g.

According to the embodiment, the width of the gap g is accurately adjustable, and, therefore, the width of the gap g after cleaning is, for example, accurately returnable to the width before the cleaning. When the gap is expanded, paper dust, and so on, clogged within the gap g between the ink fountain 6 and the ink fountain roller 26 are evacuated, and, therefore, normal printing is performed. When a printing machine is paused during the night or the like, the plate 10 is made in contact with the ink fountain roller 26 by the biasing force from the biasing device 36, and, therefore, no ink leakage happens. Therefore, it is not needed to evacuate the ink in the ink reservation 14 before the pause of the printing machine 2.

According to the embodiment, the left and right two advancement and retraction mechanisms 12 are both provided with servomotors 41. As a alternative, one servomotor may be provided, for example, at a center portion of the rear face of the frame 8, and the output shaft of the servomotor may be elongated to the pair of the left and right advancement and retraction mechanisms. However, this configuration may allow the decrease in the control precision of the width of the gap g due to the torsion of the shaft. As an further alternative, one advancement and retraction mechanism is provided at a central portion of the rear face of the frame 8, and a pair of guides 37 may be provided at both sides of the left and right direction. However, this configuration may allow the tilting of the plate 10 during advancing and retracting.

When the width of the gap g is adjusted accurately by the advancement and retraction mechanism 12 according to the embodiment, the following advantages are achieved.

By enlarging the gap g temporally, contaminants such as paper dust are eliminated from the gap between the ink fountain 6 and the ink fountain roller 26.

Ink feeding amount from the ink reservation 14 can be controlled according to the species of ink, desired printing density, and so on.

DESCRIPTION OF SYMBOLS

| | |
|---|---|
| 2 | printing machine |
| 4 | ink fountain device |
| 6 | ink fountain |
| 8 | frame |
| 10 | plate |
| 12 | advancement and retraction mechanism |
| 14 | ink reservation |
| 16 | film |
| 17,18 | roller |
| 20 | blade |
| 21 | pan |
| 22 | advancement and retraction mechanism |
| 24 | controller |
| 26 | ink fountain roller |
| 28 | ink feeder |
| 30 | ductor roller |
| 32 | ink distribution roller |
| 34 | printing plate roller |
| 36 | biasing device |
| 37 | guide |
| 40 | recess |
| 41 | servomotor |
| 42 | output shaft |
| 43 | cam |
| 44 | rod |
| 45 | adjusting screw |
| 46 | casing |
| 47 | joining plate |
| 48 | knock pin |
| 51 | plate |
| 52 | bolt |
| 53 | compressed spring |
| S | sensor |
| g | gap |

What is claimed is:

1. An ink fountain device having an ink fountain for forming ink reservation between an ink fountain roller in a printing machine, said ink fountain comprising:

a fixed frame;

a plate slidable on an upper surface of the frame;

an advancement and retraction mechanism for advancing and retracting the plate with respect to the frame, said advancement and retraction mechanism including:

a motor;

a cam which is fixed to an output shaft of the motor, is integrally rotatable by rotation of the output shaft, and has a cam surface shifted from an exact circle; and a rod which is in contact with the cam surface and advances and retracts due to rotation of the cam surface, and a biasing device biasing said plate toward the ink fountain roller in a direction keeping contact between said rod and said cam surface such that the plate is configured to advance and retract with respect to the frame by the advancement and retraction of the rod due to the rotation of the cam surface.

2. The ink fountain device according to claim 1, wherein said advancement and retraction mechanism further comprises:

a joining member fixed to said plate and having a screw hole; and an adjusting screw having one end in contact with said rod and another end screwed in the screw hole of the joining member.

3. The ink fountain device according to claim 1, wherein said rod has an end directed to the ink fountain roller and in contact with said cam surface.

4. The ink fountain device according to claim 1, wherein the ink fountain further comprises a blade configured to advance and retract in a synchronized manner with the advancement and retraction of said plate and to scrape ink from the ink fountain roller.

5. The ink fountain device according to claim 4, wherein the ink fountain further comprises: a means for detecting clogging of a gap between the ink fountain roller and the plate of the ink fountain; and a controller for controlling said advancement and retraction mechanism such that the plate is retracted from the ink fountain roller to enlarge the gap and to evacuate ink clogged within the gap, when said clogging is detected.

6. A printing machine comprising: the ink fountain device according to claim 4; the ink fountain roller; a ductor roller receiving ink from the ink fountain roller; at least an ink distribution roller, a printing plate roller; and an ink feeder feeding ink to the ink reservation.

7. A cleaning method of ink reserved in an ink fountain in a printing machine, said printing machine including: the ink fountain; an ink fountain roller; a ductor roller receiving ink from the ink fountain roller; a printing plate roller; and a blade for scraping ink from the ink fountain roller, said ink fountain including: a fixed frame; a plate slidable on the upper surface of the frame; and an advancement and retraction mechanism for advancing and retracting the plate with respect to the frame, and said advancement and retraction mechanism including: a motor; a cam which is fixed to an output shaft of the motor, is integrally rotatable by rotation of the output shaft, and has a cam surface shifted from an exact circle; and a rod which is in contact with the cam surface and advances and retracts due to rotation of the cam surface, and the ink fountain further includes a biasing device biasing said plate toward the ink fountain roller in a direction keeping contact between said rod and said cam surface such that the plate is configured to advance and retract with respect to the frame by advancement and retraction of the rod due to the rotation of the cam surface, said method comprising:

retracting said plate from the ink fountain roller and enlarging the gap between the ink fountain roller and said plate thereby, in order to evacuate ink clogged within the gap; and advancing said blade toward the ink fountain roller, in order to scrape ink from the ink fountain roller.

* * * * *